United States Patent [19]

Wolowodiuk

[11] 3,930,537

[45] Jan. 6, 1976

[54] HEAT EXCHANGER

[75] Inventor: Walter Wolowodiuk, New Providence, N.J.

[73] Assignee: The United States of America as represented by the United States Energy Research and Development Administration, Washington, D.C.

[22] Filed: May 6, 1974

[21] Appl. No.: 467,168

[52] U.S. Cl. ..... 165/158; 122/32; 165/160

[51] Int. Cl. ..... F28f 9/02

[58] Field of Search ..... 122/32, 34; 165/158–163

[56] References Cited

UNITED STATES PATENTS

| | | | |
|---|---|---|---|
| 3,182,719 | 5/1965 | Christ | 165/159 |
| 3,490,521 | 1/1970 | Byerley | 165/161 |
| 3,683,866 | 8/1972 | Zmoia | 122/32 |
| 3,768,554 | 10/1973 | Stahl | 165/173 |

*Primary Examiner*—Manuel A. Antonakas
*Assistant Examiner*—Theophil W. Streule, Jr.

[57] ABSTRACT

A heat exchanger of the straight tube type in which different rates of thermal expansion between the straight tubes and the supply pipes furnishing fluid to those tubes do not result in tube failures. The supply pipes each contain a section which is of helical configuration.

6 Claims, 1 Drawing Figure

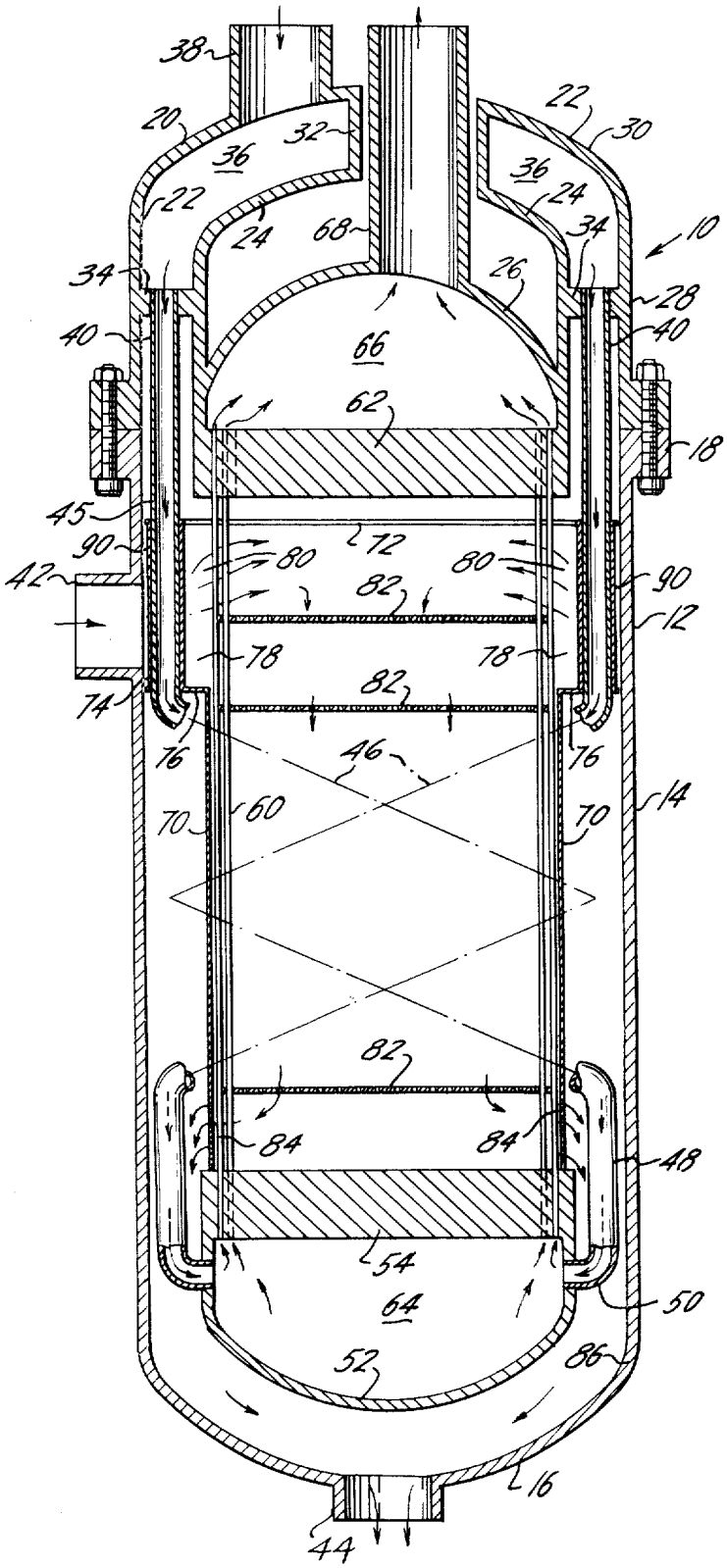
38
20
36
32
22
24
68
22
30
36
24
34
10
34
26
28
40
40
66
62
18
45
90
72
80
80
42
82
90
12
78
78
82
74
76
46
76
14
70
60
70
82
84
84
48
54
64
50
52
86
16
44

HEAT EXCHANGER

SOURCE OF THE INVENTION

This invention was made or conceived in the course of or under a contract, sub-contract or arrangement entered into with or for the benefit of the Atomic Energy Commission.

BACKGROUND OF THE INVENTION

Of the several types apparatus used in industry to indirectly exchange between fluids there are many situations where the straight tube type is the most desirable. In the straight tube type of heat exchanger one fluid passes through a straight tube of heat conductive metal having a wall thickness thin enough to permit the efficient exchange of heat between the fluid within the tube and the fluid flowing over it.

A straight tube heat exchanger can be cleaned and inspected more easily than one in which the heat exchange tubes are of configuration where the tubes are not straight. An eddy current device, for example, can be passed down a straight tube to allow for examination. Cleaning devices which could never be passed through a bent tube can quite easily be passed through a straight tube when it is desired to clean out the tubes during a major maintenance procedure. Moreover, in case a tube should fail, a straight tube can be plugged, by internal welding devices or explosive plugs.

Often the heat exchange fluid which is flowed through the heat exchange tubes is passed longitudinally to the lower portion of the heat exchanger through a centrally located supply conduit within the heat exchanger and then allowed to reverse direction and come back through the heat exchange tubes. For example, in heat exchangers where the fluid which supplies heat to the heat exchanger, that is the primary fluid is liquid sodium, the sodium preferably passes downward over the tubes and it is often required that the secondary fluid passes longitudinally of the tubes in the direction of the primary sodium through a centrally located supply pipe into a chamber below a tube sheet where the secondary fluid reverses its direction to flow back through the heat exchange tubes. Sudden changes in temperature of either the secondary or primary fluids can cause the supply pipe and tubes to contract or expand at different rates thus overstressing the tubes. The rate of expansion or contraction due to a sudden change in the temperature of the fluids passing through the supply pipe and heat exchange tubes will cause the heat exchange tubes to change in length faster than the supply pipe because of the thin walls of the heat exchange tubes. This causes the supply pipe to exert a force on the tubes which could lead to tube failures.

SUMMARY OF THE INVENTION

It is an object of the present invention to overcome drawbacks found in the prior art such as those discussed above. Accordingly, a straight tube heat exchanger is provided with supply pipes of a configuration which allows them to expand or contract without exerting an appreciable force on the heat exchange tubes.

BRIEF DESCRIPTION OF THE DRAWING

The drawing is a front view, partly in section, showing a heat exchanger made in accordance with the present invention. The drawing shows a heat exchanger indicated generally as 10 having an outer shell 12 which comprises a longitudinal cylindrical section 14 and a bottom 16 closed except for an exhaust opening 44 and which has at its top an upper flange 18. The flange 18 is annular and projects outward from the top of the cylindrical section 14. The top of the heat exchanger 10 has a head section 20 which has three walls, 22, 24 and 26 which extend generally upward and inward. The wall 22 is outward of the walls 24 and 26 and includes a lower cylindrical section 28 which at its top merges with a curved inwardly flared upper section 30. The wall 24 is inside of and generally concentric with the wall 22. At their inner edges the walls 22 and 24 are joined to an annular spoolpiece 32 which has substantially restricted walls. An annular plate 34 bridges the walls 22 and 24 at a location in the middle of the lower cylindrical section 28. The walls 22 and 24 along with the spoolpiece 32 and annular plate 34 define an annular inlet chamber 36. An inlet 38 through the wall 22 can be connected to a conduit not shown for admitting a heat exchange fluid into the inlet. In the preferred embodiment the fluid coming through the inlet 38 is a secondary fluid such as liquid sodium. The secondary fluid in the inlet chamber 36 flows downward through supply pipes 40 which extend down through the annular plate 34. An intake 42 permits primary fluid such as liquid sodium to come into the heat exchanger. The primary fluid eventually exits through the exhaust 44 to be recycled to the heat source which is not shown.

The supply pipes 40 each have portions 45 which are generally straight and portions 46 which are helical in configuration. The helical portions 46 extend downward adjacent to the cylindrical section 14 of the shell 12 to a level adjacent to the bottom of the cylindrical section 14. Here they merge with straight portions 48, which at their bottoms, curve inward at 50. The curved bottoms 50 project through a dish shaped plate 52 which at its top merges with a lower tube sheet 54.

Extending upward from the lower tube sheet 54 is a plurality of straight heat exchange tubes 60 which extend up to an upper tube sheet 62 which is above the intake 42. The secondary fluid flowing down through the supply pipes 40 including the helical portions 46 and the straight portions 48 flow into a lower chamber 64 which is defined by the plate 52 and the lower tube sheet 54. Thereafter, the secondary fluid flows upward through the straight heat exchange tubes 60 and through the upper tube sheet 62 and into an upper chamber 66 which is defined by the lower tube sheet 62 and the wall 26. The secondary fluid then leaves the heat exchanger 10 through an outlet 68 which passes through the wall 26 and through the spoolpiece 32 to apparatus not shown which makes use of the secondary sodium.

A shroud 70 which is generally cylindrical and extends from the lower tube sheet 54 to a top circular plate 72 just below the upper tube sheet 62 separates the straight heat exchange tubes 60 from the supply pipes 40. The top plate 72 and lower support plate 76 are of a greater diameter than is the shroud 70 and extend laterally beyound the secondary supply pipes 40. These define along with the upper portion of the outer shroud 70 and the cylindrical section 14 of the shell 12 a distribution chamber 78. Distribution openings 80 are provided in the shroud 70 between the plates 72 and 76 to allow the primary fluid to enter into the shroud 70 below the plate 72.

The straight heat exchange tubes 60 extend through openings in a series of horizontal tube support plates 82 which are supported from the upper tube sheet 62 by the rods (not shown). The openings in the support plates are provided to allow the primary fluid to flow down through the support plates 82.

At the lower portion of the shroud 70 above the lower tube sheet 54 are a series of exit openings 84 which allow the primary fluid which has passed down over the heat exchange tubes 60 to pass outward over the lower tube sheet 54 and down through a space 86 between the plate 52 and the bottom 16 of the outer shell 12 to the exhaust 44.

In operation primary fluid coming in at the intake 42 passes into the distribution chamber 78 through which pass a series of sleeves 90 which encircle the straight portions 45 of the supply pipes 40 between the plates 76 and 72 and thereby protect them from the hot primary fluid. Thereafter the fluid passes through the openings 80 and down through the tube support plates 82 and over the heat exchange tubes 60 to leave the space within the shroud 70 through the exit openings 84. Thereafter the primary fluid flows downward through the space 86 and out through the exhaust 44. Secondary fluid coming in through the inlet 38 and into the inlet chamber 36 passes down through the supply pipes 40, and around the heat exchange tubes 60 through the helical sections 46 to the lower straight portions 48 and then inward through the curved portions 50 into the lower chambers 64 to reverse direction and flow up through the heat exchange tube 60 which extend between the lower tube sheet 54 and the upper tube sheet 62. The secondary fluid is collected in the upper chamber 66 to leave the heat exchanger 10 through the outlet 68.

The present heat exchanger 10 is especially advantageous in that a sudden change in temperature in either the primary or secondary fluid which would cause a different rate of thermal expansion or contraction in the supply pipes 40 and the heat exchange tubes 60 will not result in a large force causing a rupture of either the supply pipe or the heat exchange tubes. Since the supply pipes 40 have helical sections 46, the change in length of either the supply pipe 40 or the heat exchange tubes 60 can be accommodated by flexure of the supply pipes 40 at the helical sections 46.

The foregoing describes the one preferred embodiment of the present invention, other embodiments being possible without exceeding the scope as defined in the following claims:

What is claimed is:

1. A heat exchanger comprising: a shell;
an upper tube sheet within said shell;
a lower sheet within said shell;
plate means below said lower tube sheet, said plate means joining with said lower tube sheet to define a chamber below said lower tube sheet;
a plurality of straight heat exchange tubes extending between said first tube sheet and said second tube sheet;
a shroud within said shell and surrounding said heat exchange tubes;
an intake in said shell for flowing a first heat exchange fluid down through said shroud, between said tube sheets and over said heat exchange tubes;
an exhaust in said shell for allowing said first heat exchange fluid to leave said shell;
an inlet in said shell for admitting a second heat exchange fluid into said shell;
an outlet in said shell for permitting said second heat exchange fluid to leave said heat exchanger;
a supply pipe connected between said inlet and said chamber, said supply pipe extending generally longitudinally, and laterally of said heat exchange tubes, said supply pipe having a helical portion encircling said shroud;
whereby differences in thermal expansion between said supply pipe and said heat exchange tubes will not result in structural failure because said helical portion will flex to accommodate the difference in thermal expansion.

2. The heat exchanger defined in claim 1 wherein both of said tube sheets are horizontal and wherein said heat exchange tubes extend vertically.

3. The heat exchanger defined in claim 2 wherein said intake is above said exhaust.

4. The heat exchanger defined in claim 3 wherein said supply pipe is one of a plurality of supply pipes.

5. The heat exchanger defined in claim 4 wherein said helical portions define a series of helices with a common axis.

6. The heat exchanger defined in claim 5 wherein said helices have equal radii of curvature.

* * * * *